United States Patent [19]

Ramsey

[11] 4,206,677

[45] Jun. 10, 1980

[54] PEDAL ACTUATOR FOR ELECTRONIC PLAYER PIANO

[75] Inventor: Vernon B. Ramsey, Lewisburg, Tenn.

[73] Assignee: Teledyne Industries, Inc., Los Angeles, Calif.

[21] Appl. No.: 925,653

[22] Filed: Jul. 17, 1978

[51] Int. Cl.[2] ..... G10F 3/00; G10F 5/00

[52] U.S. Cl. ..... 84/107; 84/23; 84/34; 84/108; 84/231; 74/562

[58] Field of Search ..... 74/532, 562; 84/17-19, 84/21, 23, 30, 33-34, 105, 107-108, 116, 225, 230-231, 358

[56] References Cited

U.S. PATENT DOCUMENTS

| | | | |
|---|---|---|---|
| 85,901 | 1/1869 | Brewer | 84/231 |
| 489,810 | 1/1893 | Hobday | 84/231 |
| 546,582 | 9/1895 | Davis | 84/18 |
| 688,013 | 12/1901 | Brown | 84/230 X |
| 1,184,244 | 5/1916 | Kelly | 84/20 |
| 1,812,706 | 6/1931 | Mednikoff | 84/231 |
| 2,047,332 | 7/1936 | Sappenfield | 84/231 |
| 3,082,641 | 3/1963 | Leiter | 74/532 |
| 4,018,128 | 4/1977 | Megee | 84/231 |

*Primary Examiner*—Lawrence R. Franklin
*Attorney, Agent, or Firm*—Jim Zegeer

[57] ABSTRACT

Pedal actuator and connection assemblies for electronic vorsetzer player piano units incorporating universal connection members between the electronic assemblies and foot pedals for converting a conventional piano to an electronic player piano are disclosed. The connection assemblies include a foot member, one for each foot pedal, which are adapted to transmit actuating forces transmitted from the player piano unit downwardly and on the rear portion of the pedal member pivoting the foot member in the second ball joint to cause an upward force on a lower pedal-engaging surface to thereby engage the lower side of the pedal therewith and thereby permit upward and downward movement of the foot without it slipping off the pedal. At the same time, since there is no positive securement of the connection assembly to the foot pedal, the vorsetzer may be easily and quickly positioned on the piano for converting a standard piano to an electronic player piano.

10 Claims, 5 Drawing Figures

PEDAL ACTUATOR FOR ELECTRONIC PLAYER PIANO

REFERENCE TO RELATED APPLICATIONS

This application is related to the following applications: U.S. Ser. No. 681,093, filed Apr. 28, 1976 for "Method and Apparatus For Reproducing a Musical Presentation" of Joseph Max Campbell; Ser. No. 681,098, filed Apr. 28, 1976 for "Demultiplex and Storage System For Time Division Multiplexed Frames of Musical Data" of William Solon Finley; Ser. No. 680,996, filed Apr. 28, 1976 for "Solenoid-Hammer Control System For The Recreation of Expression Effects From a Recorded Musical Presentation" of Joseph Max Campbell and William Solon Finley.

BACKGROUND AND SUMMARY OF THE INVENTION

The present invention is directed to an electronic vorsetzer pedal foot for converting a conventional piano to an electronic player piano. In the past, a typical vorsetzer was a unit which rested upon the keyboard or some other structure of a conventional piano and actuated the piano keys in accordance with and under the control of a conventional player piano roll. Such units were typically mechanical, pneumatic, and/or electromechanical units which had striker elements which, under control of a perforated piano roll, struck or depressed the piano keys to play the tune. With the advent of the electronic player piano units which, instead of using the conventional punched hole player piano roll, use magnetic tape preferably and typically in the form of magnetic tape cassettes. As disclosed in Vincent U.S. Pat. No. 3,905,267, Englund U.S. Pat. No. 3,604,299, and the above-identified related applications, as well as other related applications of the assignee hereof, the parallel format of the electronic player piano roll, converted to a serial format for the storage of the musical data on the magnetic tape and in time division multiplex frames of data is used to provide control signals to the solenoids of an electromagnetically operated player piano. Other forms of storage of the data may be used in accordance with the present invention, it not being limited to the type of storage of information, even being applicable to conventional solenoid or electromagnetically operated player piano systems.

In the past, there has been difficulty in securing the pedals to the vorsetzer assembly per se so that the vorsetzer itself can be easily, but not permanently, positioned in alignment with the keyboard and connection of the pedals thereto. Frequently, an internal connection is made to the piano pedals by means of an internal linkage.

An object and feature of the present invention is that it requires no modification of the conventional piano keyboard nor does it require any structural modifications of the pedal assembly. In accordance with a preferred embodiment of the present invention, the sustain and soft pedals of a typical piano are engaged by a novel mechanical foot structure which engages the pedal lever assembly in such a way that it slips on and off easily. In this way, the pedals themselves may be easily captured or engaged with the unit in such a manner that the actuating force, e.g., from the solenoid assembly (to be more fully described hereafter), pushes downward on the rear portion of the foot causing a slight upward force (from the rotational effect) on a further portion of the mechanical foot which, preferably, is padded, which portion contacts the lower side of the pedal, thereby allowing the pedal to be moved downward and upward without the mechanical foot slipping off. Moreover, by providing a pair of universal joints, one at the vorsetzer per se and one at the foot, a large range of various angles of force application to the piano pedals can be accommodated so precise alignment is not required. Moreover, the pedal actuator assembly is set up on the piano in a spring preloaded condition which aids the pedal actuating solenoid by offsetting the pedal spring already existing in the piano.

As indicated above, in a preferred embodiment of the invention, the mechanical foot is driven by a solenoid which is mounted in the vorsetzer unit itself. A spring in the vorsetzer itself biases the solenoid actuated lever in the direction of actuation and against the spring that is in the pedals. A damper device such as a dashpot is connected to the solenoid actuated lever for impeding the rapid movement of the lever. This avoids the highly undesirable boxy sounding effect as if a human player tromped hard or thumped his foot on the loud and/or sustain pedals and more closely approximates the action of the human foot in playing the soft and sustain pedals of the piano.

BRIEF DESCRIPTION OF THE DRAWINGS

The above and other objects, advantages and features of the invention will become more apparent from the following specification when taken in conjunction with the accompanying drawings wherein:

FIG. 2 also diagrammatically illustrates the position of the damper or dashpot in relation to the added spring for preventing the tromped down sound effect if the solenoid were permitted to operate the linkage without the modifying effect of the dashpot.

GENERAL DESCRIPTION

Since the present invention is concerned primarily with the driving assemblies and method for actuating the foot pedals (sustain and soft) of a conventional piano, details of the solenoid actuators for the keyboard as well as the tape unit and electronic circuitry therefor are discribed in general by reference to the electronic player piano manufactured and sold by the assignee hereof, Teledyne Industries, Inc., and are disclosed in detail in the aforementioned patent applications. Moreover, since the present invention is concerned solely with the playback function or operation, the recored assembly is not considered relevant hereto. Moreover, since the unit is mounted in the fashion of a conventional vorsetzer, e.g., over the keyboard, the mounting rack for the solenoid assemblies is mounted in a housing which is generally to be positioned directly over the piano keyboard. Such mounting structures per se form no part of the present invention. The playback assembly includes a playback logic board, driver boards and key solenoids, and a pedal solenoid assembly. In addition, a conventional magnetic cassette playback unit reads the magnetic tape and the musical note data stored thereon and converts same to actuating signals for the solenoids. The bass and treble expression information is decoded and used to control the intensity or expression effects on both the bass and treble sides of the piano keyboard. Moreover, the pedal control signals as derived from the tape player are used to drive control signals for the pedal driver solenoids.

Figure 1:
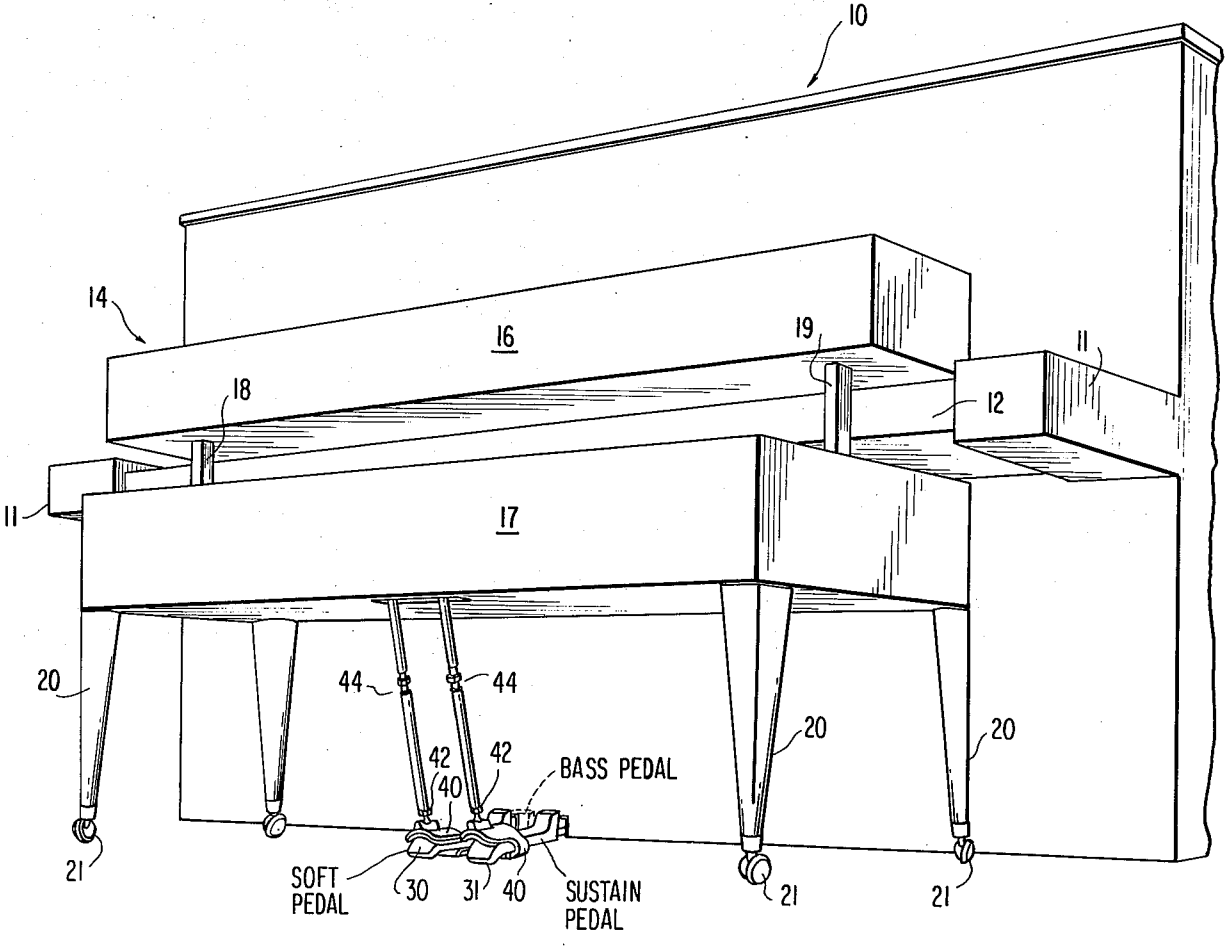
FIG. 1 is an isometric perspective view of a piano having the electronic vorsetzer of the present invention positioned thereon.

While pianos having only soft and sustain pedals are known, and the invention is shown as applied to such a piano, it will be appreciated that the vast majority of pianos have the sustain and soft pedals as well as a bass pedal, but in the preferred embodiment of the present invention, only the sustaining and soft pedals are driven—a phantom or dotted position for the bass pedal is shown in FIG. 1 of the drawings with the soft pedal being on the left, the sustain pedal on the right and the bass pedal in the center.

Referring generally to FIG. 1, a partial isometric view of a piano 10 is illustrated with a cantilevered support 11 for the piano keyboard 12. It will be appreciated that in many different types of pianos a leg or pedestal under cantilever support 11 can be provided. Piano 10 is illustrated as resting on a floor 13 and positioned on the piano is the vorsetzer 14 itself. Vorsetzer 14 has an upper unit 16 and a lower unit 17 which supports upper unit 16 on a pair of vertical posts or pedestals 18 and 19, respectively, there being more or less pedestals as needed for structural stability. The bank of key solenoids, 88 if there were to be 88 keys of the piano actuated, but in a typical and preferred embodiment the four keys on the end are not played and hence only 80 keys are played, are carried on a frame (not shown) in upper unit 16. This provides additional room proximate the ends of the unit to fit the vorsetzer over the keyboard 12 without difficulty for any type of piano since the spaces between the piano keys are standard. The key solenoids and their actuating plungers which project downwardly towards the keyboard are aligned over the keys of the keyboard 12. Lower unit 17 carries the electronic circuitry as well as the tape playback unit (instead of a magnetic tape cassette other forms of record could be used, e.g., perforated rolls, discs, etc.) which may be positioned in a drawer in the front side of lower unit 17 or in a receptacle in the upper surface of lower unit 17. Lower unit 17 is supported by four legs 20, each of which is provided with casters 21 so that the vorsetzer may be easily rolled up to the piano for attachment thereto. The only physical connection to the piano per se is in connection with the soft and sustain pedals, and, in the preferred embodiment, this engagement or connection is not a positive connection for purposes to be described more fully hereinafter.

SOLENOID-DASHPOT DRIVE ASSEMBLY

Figure 2:
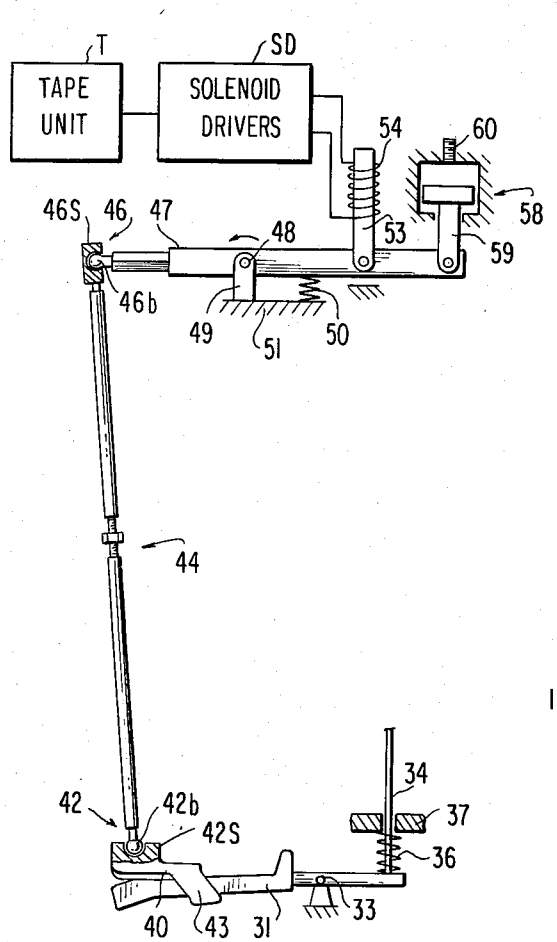
FIG. 2 is a schematic diagram illustrating the pedal actuator assembly as set up on the piano in a spring "preloaded condition" which aids the pedal actuating solenoid by offsetting the pedal spring already existing in the piano.
Figure 3:
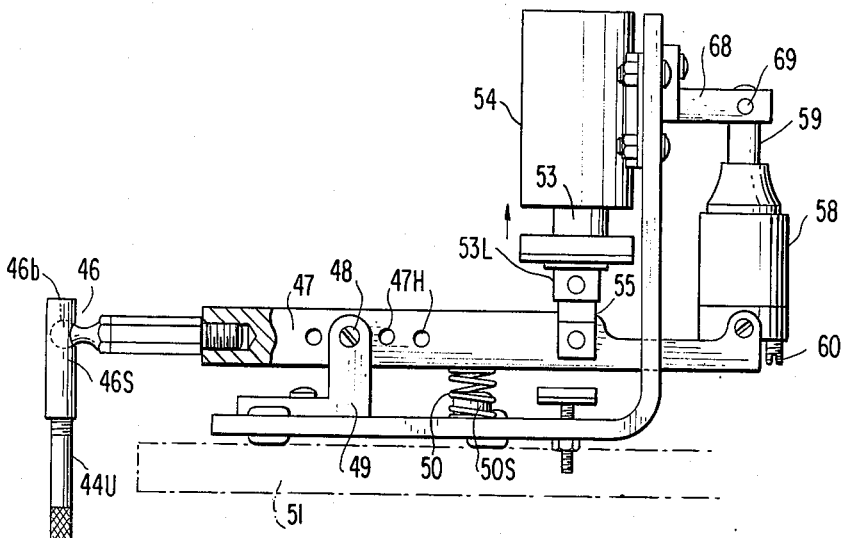
FIG. 3 illustrates a side view of the invention.
Figure 4:
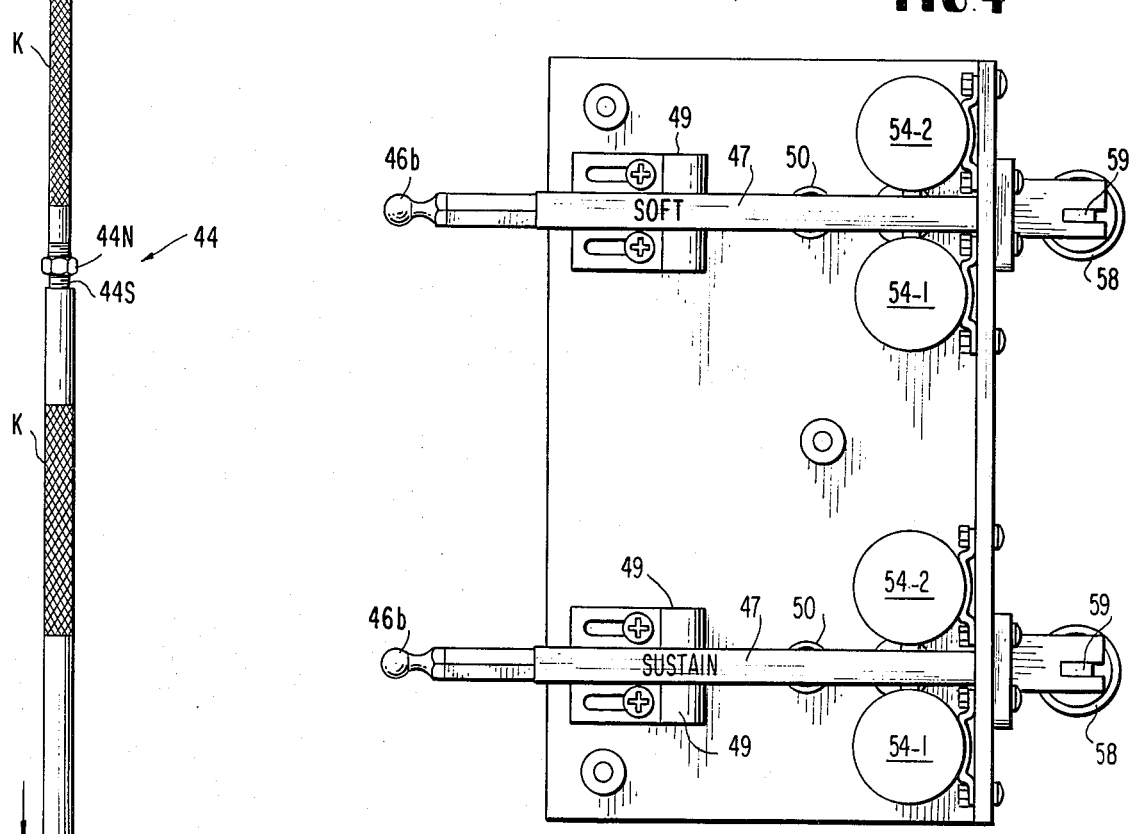
FIG. 4 is a top plan view of the part shown in FIG. 3.
Figure 5:
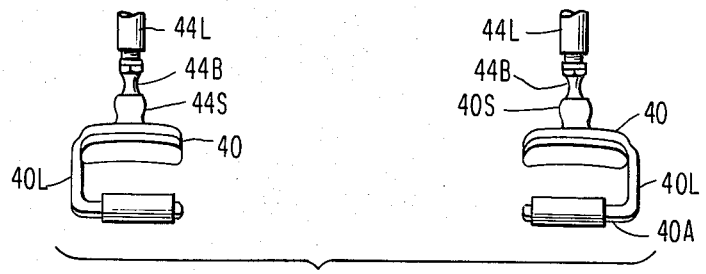
FIG. 5 is a front elevational view of the "foot" of the actuator assemblies.

Soft and sustain pedals 30, 31, respectively, have identical solenoid-dashpot and linkage mechanisms and only one will be described, it being understood that the invention is applicable to both the soft and sustain pedals with the drive being shown in FIG. 2 being a right-hand view of the sustain pedal assembly. As there illustrated, the sustain pedal 31 is on a lever 32 which is pivoted as at 33 on a portion of the piano frame (not shown). Lever 32 is connected through an actuating connection 34 to the sustain mechanism of the piano (not shown) in a conventional fashion. In addition, a spring 36 is illustrated diagrammically between the end of lever 32 and a further fixed portion of the frame 37 and the end of lever 32 biases the lever in an up position so that as in normal operation, the pianist's foot on lever 31 is required to push lever 31 down (counterclockwise about pivot 33) in order to push rod 34 up to actuate the sustain mechanism of the piano.

Mechanical foot 40 which is described in greater detail hereinafter, engages sustain pedal 31 and is designed to permit the sustain pedal to be captured easily such that the actuating force pushing downwardly on the rear portion of the foot (the outward end of pedal 31) causes a slight upward force from the rotational effect about the ball joint 42 on the lower padded extension 43 which contacts the lower or under-side of pedal 31, thereby allowing the piano pedal to be moved downward and upward without the foot slipping off. At the same time, the foot may be disengaged from the pedal quite easily since there is no positive securement of the foot to the pedal. The outer end of foot 40 has a ball joint 42, the ball being rigid and an elongated connecting member or linkage assembly 44 to upper ball joint 46. The ball and socket of ball joints 42 and 46 can obviously be reversed with the ball 42*b* on foot 40 and socket 42*s* on the lower end of linkage 44. Ball joint 46 has a ball 46*b* and socket 46*s* on the upper end of linkage 44.

Upper ball 46*b* connects the linkage assembly 44 with an actuating lever 47 in lower unit 17. Linkage assembly 44 has an upper rod portion 44*u* adjustably connected to lower rod portion 44L by threaded screw adjustment member 44*s* on the end of upper rod 44*u*. A lock nut 44*n* maintains linkage 44 at its adjusted length. Lever 47 is pivoted on pin 48 on a yoke or saddle 49, the position of pin 48 in lever 47 being selected in one of holes 47*h*. A spring 50, on spring stud 50*s*, between a portion of the frame 51 on lower unit 17, biases or urges lever 47 to rotate in a counterclockwise direction about pivot pin 48 which thereby urges linkage assembly 44 downward to maintain foot 40 in engagement with pedal 31. The force of spring 50 is therefore adapted to aid the piano pedal actuating solenoid by offsetting the effect of pedal spring 36 (FIG. 2). Lever 47 extends to the right of spring 50 and has connected thereto the armature 53 of a solenoid pair 54-1 and 54-2 which receive control signals from solenoid driver SD (FIG. 2) and the tape unit as described earlier. The armatures 53 of solenoid pairs 54-1 and 54-2 are connected to a common device 53L which is pivotally connected to link 55 which, in turn, is pivotally connected to lever 47.

In addition, there is provided an adjustable damper or dashpot 58 connected by a dashpot plunger 59 to dashpot mounting bracket 68. Dashpot 58 is pivotally secured between the extended right end 47 RE of lever 47 and bracket 68. Dashpot 58 has an adjustable screw orifice 60 so as to permit the damping force of dashpot 58 to be adjusted easily. This system of the spring 50 acting always to push down on linkage assembly 44 and thus maintain the pedal foot in operative engagement with pedal 31 and also to offset the pedal spring 36 existing in the piano, cooperatively acts with the damper or dashpot 58 so that when the electrical energy is applied suddenly to solenoid coil 54, armature 53 is rapidly drawn upwardly to thereby move lever arm 47 in a counterclockwise direction. However, the damper 58 has the overall effect of avoiding a box-like thumping sound as if one suddenly tromped his foot upon a pedal. Upon the de-energization of solenoid coil 54, spring 36 biases the operating lever 32 of pedal 31 in a clockwise direction thereby moving linkage assembly 44 in an upward direction and turning lever 47 in a clockwise direction thereby maintaining the preloading condition to thereby aid the pedal actuating solenoids 54.

Thus, the objects, advantages and features of the invention as set forth herein and in the drawings have been achieved in a simple and inexpensive fashion. The vorsetzer can easily be positioned for "attachment" to the piano (or organ or other musical instrument having foot pedals) which requires no internal or external modification and requires no "positive" securement to the foot pedals.

While there has been disclosed and described a preferred embodiment of the invention, it will be appreciated that various modifications, adaptations and uses of the invention will be apparent to those skilled in the art and coming within the spirit and scope of the invention as defined in the claims concluding this specification.

What is claimed is:

1. A foot member for engagement with a foot pedal of a musical instrument comprising, an upper pedal surface engaging member, a lower pedal surface engaging member, means interconnecting said upper and lower pedal engaging members such that the upper pedal engaging member engages an outer upper surface portion of said foot pedal and said lower pedal engaging member engages an inner lower surface of said foot pedal, and force receiving means on said foot member, including a universal joint, for causing said lower pedal surface engaging member to engage said lower pedal surface upon said upper pedal surface engaging member engaging said outer upper surface of said foot pedal.

2. The foot member defined in claim 1 wherein said lower pedal surface engaging member includes a cushioned pad.

3. In a vorsetzer, a solenoid actuated linkage for operating the foot pedals thereof, improvement in the coupling to said foot pedal comprising the foot member defined in claim 1.

4. A pedal actuator for an electronic vorsetzer comprising, a link member, a first pivot joint on the upper end of said link member, said first pivot including a connector extending therefrom for securement to a pedal solenoid actuator, a second pivot joint at the lower end of said link member, a foot member secured to said second pivot joint for engaging the pedal of a piano, said foot member having an upper pedal engaging surface and a lower pedal engaging surface spaced such that any actuating force transmitted downwardly by said link member pushes downwardly on the upper pedal engaging surface of the foot member, pivoting said foot member at said second pivot joint to cause an upward force on said lower pedal engaging surface to thereby engage the lower side of the pedal therewith, whereby said pedal can be moved downwardly and upwardly without said foot slipping off.

5. The invention defined in claim 4 wherein said upper and lower pedal engaging surfaces are padded.

6. The invention defined in claim 4 wherein the length of said link member is variable.

7. The invention defined in claim 4 wherein said first and said second pivot joints are universal joints.

8. The invention defined in claim 7 wherein said universal joints are ball and socket joints.

9. The invention defined in claim 4 wherein said connector extending from said first pivot joint includes a lever, said pivot joint being on one end of said lever and said solenoid actuator being spaced therefrom.

10. In a vorsetzer having a pedal actuator assembly for a piano, said actuator assembly having a solenoid connected to a source of control signals, and a dashpot connected to said solenoid to avoid any box-like thumping sound, the improvement for coupling the movement of said solenoid to the piano pedal comprising a foot member and at least one universal joint connected to said solenoid, said foot member having an upper pedal engaging surface and a lower pedal engaging surface spaced such that any actuating force transmitted downwardly by said solenoid pushes downwardly on said upper pedal engaging surface of said foot member to cause said foot member to pivot at said universal joint to cause an upward force on said lower pedal engaging surface to thereby engage the lower side of the pedal therewith, whereby said pedal can be moved downwardly and upwardly without said foot slipping off.

* * * * *